US005226196A

United States Patent [19]

Humlan

[11] Patent Number: 5,226,196

[45] Date of Patent: Jul. 13, 1993

[54] DRAIN STOPPER APPARATUS

[76] Inventor: Michael Humlan, 747 Taylor Ave., Pitcairn, Pa. 15140

[21] Appl. No.: 795,393

[22] Filed: Nov. 21, 1991

[51] Int. Cl.[5] ..... A47K 1/14

[52] U.S. Cl. ..... 4/295; 4/661

[58] Field of Search ..... 4/286, 293-295, 4/661

[56] References Cited

U.S. PATENT DOCUMENTS

| | | | |
|---|---|---|---|
| 426,939 | 4/1890 | Jones | 4/295 X |
| 1,659,839 | 2/1928 | Smith | 4/293 |
| 4,112,527 | 9/1978 | Giubilo | 4/295 X |

FOREIGN PATENT DOCUMENTS

| | | | |
|---|---|---|---|
| 0232852 | 9/1944 | Switzerland | 4/295 |
| 2211729 | 12/1989 | United Kingdom | 4/295 |

*Primary Examiner*—Charles E. Phillips

*Attorney, Agent, or Firm*—Hugh E. Smith

[57] ABSTRACT

A drain stopper including an inverted conical head fixedly and coaxially mounting a single shaft extending upwardly of the head terminating in a shaft head for ease of insertion and removal of the apparatus relative to an associated drain. A modification of the invention includes a stepped conical head to accommodate various diameters of drains, as well as a fluid port structure to project soap and the like within a water environment to enhance amusement and enjoyment of the organization by children.

3 Claims, 4 Drawing Sheets

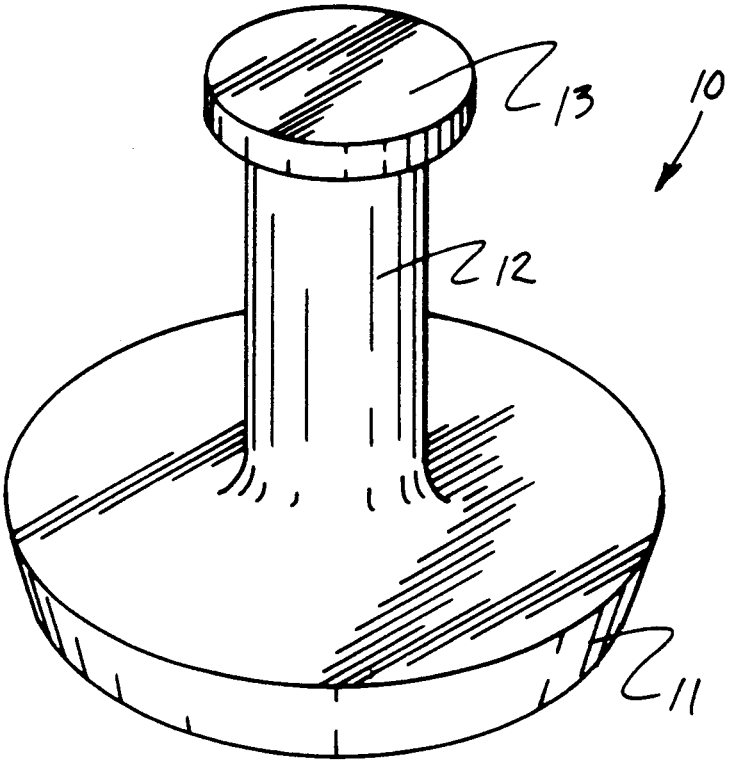
Fig 1
Fig 2
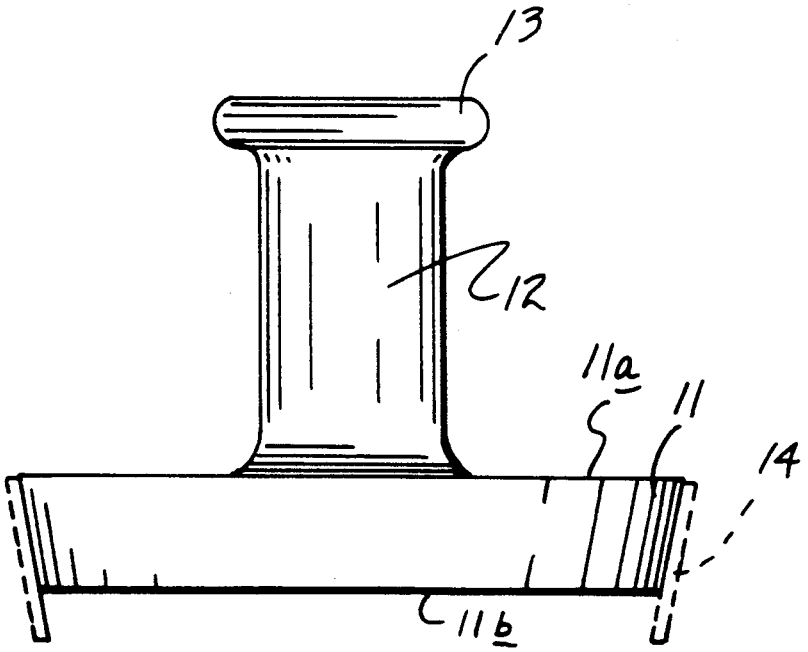

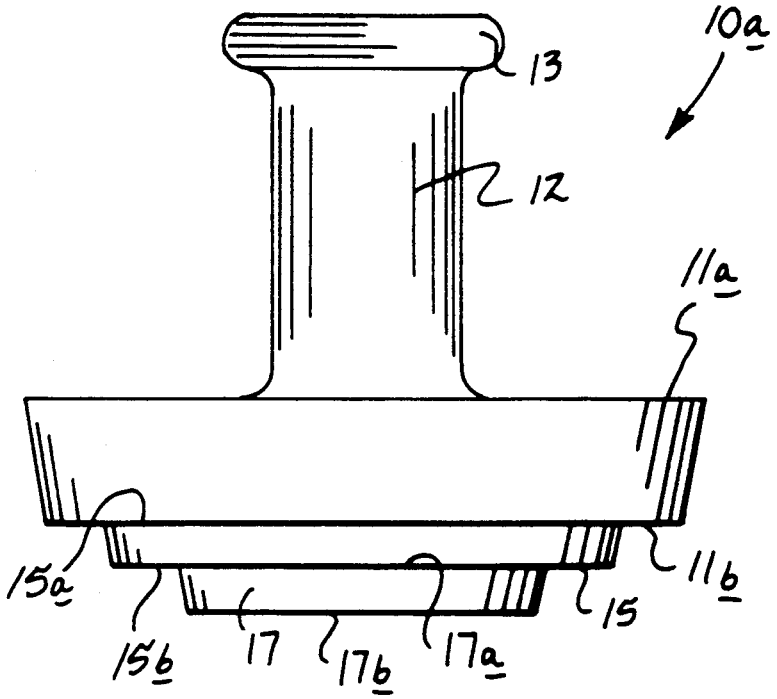
FIG 3
FIG 4
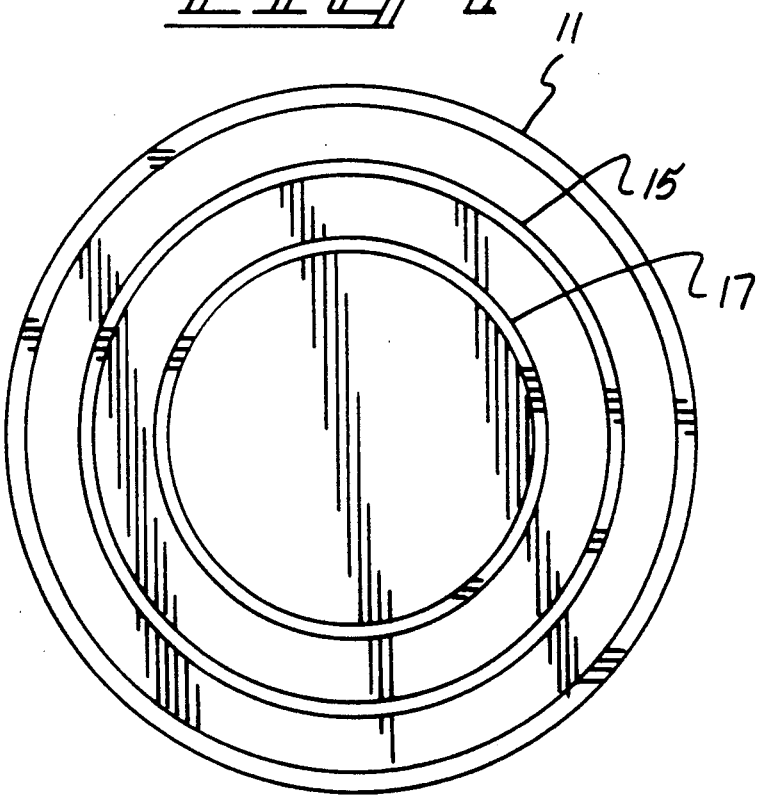

DRAIN STOPPER APPARATUS

BACKGROUND OF THE INVENTION

1. Field of the Invention

The field of invention relates to drain stopper apparatus, and more particularly pertains to a new and improved drain stopper apparatus wherein the same is arranged and formed of a resilient polymeric material to accommodate in a fluidsealed relationship an associated fluid drain.

2. Description of the Prior Art

Drain stopper apparatus of various types have been utilized throughout the prior art. Such apparatus may be of a complex construction, such as exemplified in U.S. Pat. No. 4,007,500 to Thompson wherein a bathtub stopper includes telescoping portions to permit selective lifting and receding of a central portion relative to a surrounding member to effect selective plugging of the associated drain.

U.S. Pat. No. 4,752,035 to Felder sets forth a drain stopper structure including a cylindrical head member and projecting flange to be received within a drain.

As such, it may be appreciated that there continues to be a need for a new and improved drain stopper apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of drain stopper apparatus now present in the prior art, the present invention provides a drain stopper apparatus wherein the same is arranged to permit ease of projection and ease of removal of a drain stopper relative to the associated drain. As such, the general purpose of the present invention, which will be described subsequently in greater detail, is to provide a new and improved drain stopper apparatus which has all the advantages of the prior art drain stopper apparatus and none of the disadvantages.

To attain this, the present invention provides a drain stopper including an inverted conical head fixedly and coaxially mounting a single shaft extending upwardly of the head terminating in a shaft head for ease of insertion and removal of the apparatus relative to an associated drain. A modification of the invention includes a stepped conical head to accommodate various diameters of drains, as well as a fluid port structure to project soap and the like within a water environment to enhance amusement and enjoyment of the organization by children.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain stopper apparatus which has all the advantages of the prior art drain stopper apparatus and none of the disadvantages.

It is another object of the present invention to provide a new and improved drain stopper apparatus which may be easily and efficiently manufactured and marketed.

It is a further object of the present invention to provide a new and improved drain stopper apparatus which is of a durable and reliable construction.

An even further object of the present invention is to provide a new and improved drain stopper apparatus which is susceptible of a low cost of manufacture with regard to both materials and labor, and which accordingly is then susceptible of low prices of sale to the consuming public, thereby making such drain stopper apparatus economically available to the buying public.

Still yet another object of the present invention is to provide a new and improved drain stopper apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic side view of the instant invention.

FIG. 3 is an orthographic side view of a modification of the invention.

FIG. 4 is an orthographic bottom view of the modified invention.

FIG. 8 is an orthographic side view of the further modified aspect of the invention, including illustration of the fluid-filled assembly.

DESCRIPTION OF THE PREFERRED EMBODIMENT

Figure 5:
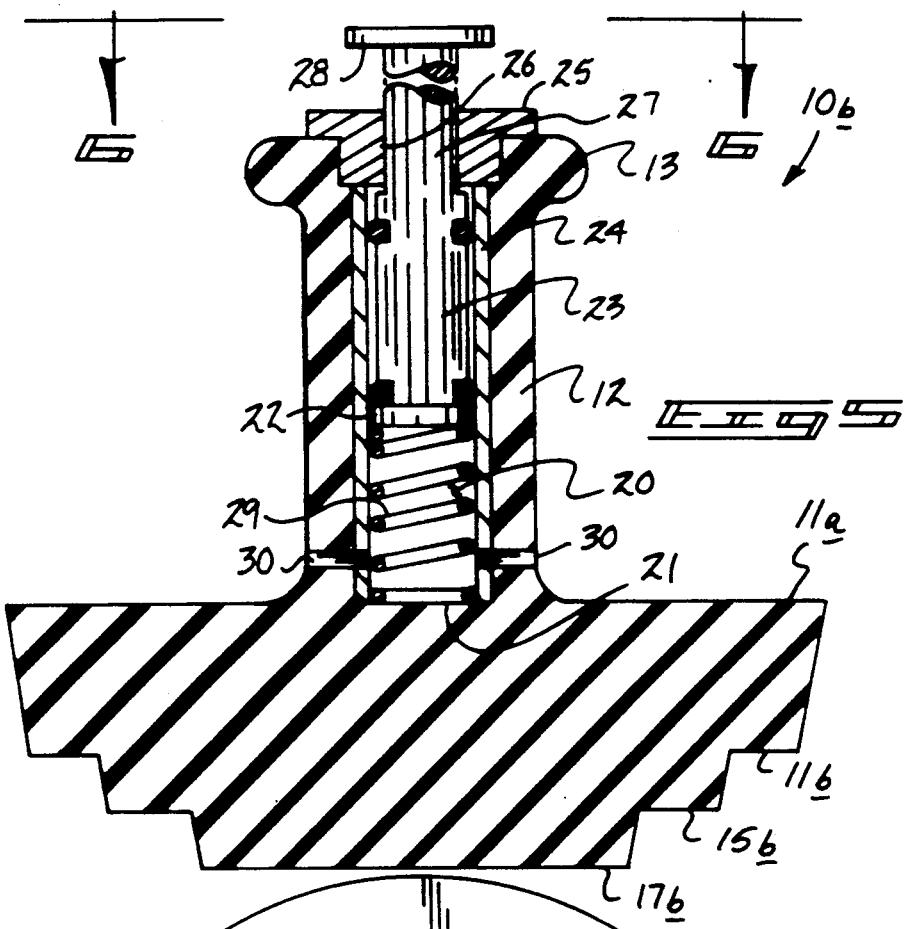
FIG. 5 is an orthographic cross-sectional illustration of a further modified aspect of the invention.

With reference now to the drawings, and in particular to FIGS. 1 to 8 thereof, a new and improved drain stopper apparatus embodying the principles and concepts of the present invention and generally designated by the reference numerals 10, 10*a*, 10*b* and 10*c* will be described.

More specifically, the drain stopper apparatus 10 of the instant invention as illustrated in FIGS. 1 and 2 includes an inverted truncated conical base 11 defining a first base, to include a cylindrical handle shaft 12 coaxially aligned and integrally mounted to a top surface 11*a* of the conical base 11, as the first base top surface 11*a* is defined by a first diameter that is spaced from and parallel a first base bottom surface 11*b* of a second diameter less than the first diameter for projection of the first base 11 within a fluid drain 14, of a type such as exemplified in FIG. 2. A shaft head 13 is fixedly mounted to an upper terminal end of the shaft 12 to provide ease of grasping of the apparatus for ease of insertion and removal relative to the fluid drain 14. It should be noted that the cylindrical shaft head 13 is defined by a fourth diameter greater than the third diameter of the shaft 13, yet less than the second diameter of the base 11, and the diameter of the shaft 12 is less than the first or second diameters of the top or bottom surfaces 11*a* and 11*b* respectively.

The modified aspect of the invention 10*a*, as illustrated in the FIGS. 3 and 4, includes a respective second and third inverted conical base 17 to define a stepped base portion as the second conical base 15 includes a second base top surface 15*a* contiguous with the first base bottom surface 11*b* coaxial therewith defined by a fifth diameter less than the second diameter of the bottom surface 11*b*. Further, the use of a third base 17 coaxial with the first and second bases 11 and 15 respectively includes a third base top surface 17*a* defined by a seventh diameter less than the sixth diameter, and a third base bottom surface 17*b* defined by an eighth diameter less than the seventh diameter, where it should be noted that each bottom and top surface of each respective base is arranged in a parallel and coaxial relationship relative to one another, as well as to the handle shaft 12 and the handle shaft head 13.

Figure 6:
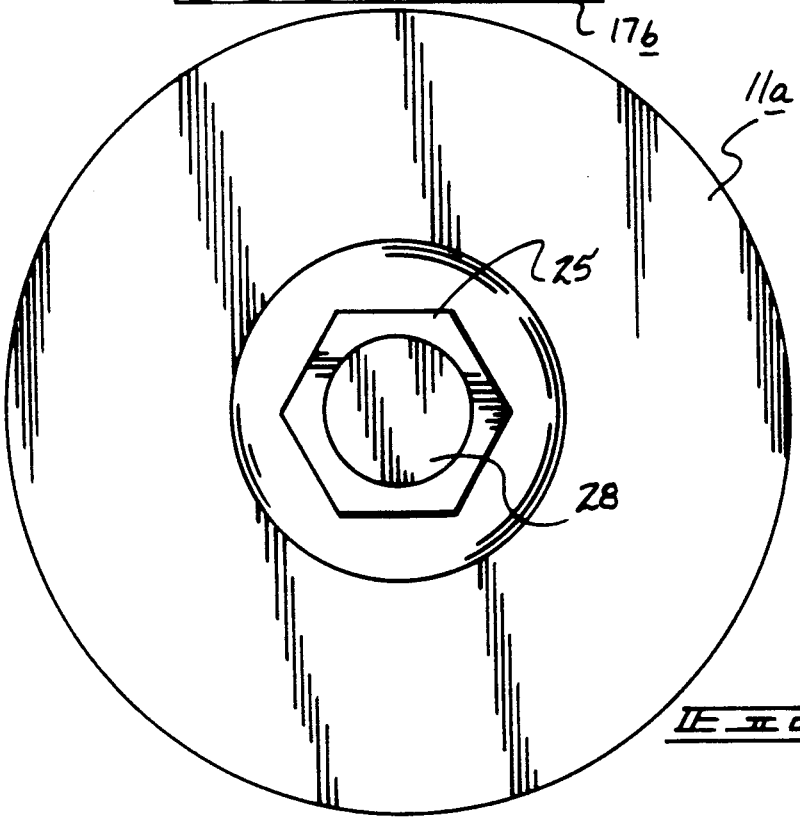
FIG. 6 is an orthographic top view, taken along the lines 6—6 of FIG. 5 in the direction indicated by the arrows.

The further modified aspect of the invention 10*b*, as illustrated in the FIGS. 5 and 6, includes the handle shaft 12 formed with a shaft cavity 20 coextensive therewith defined by a shaft cavity floor 21 generally coplanar with the first base top surface 11*a* and defined by a rigid cylindrical sleeve 24 to provide geometric integrity to the shaft cavity 20. A piston 22 is slidably and sealingly mounted within the sleeve 24 and is mounted to a lower distal end of a piston rod 23, wherein the piston rod 23 is defined by a shaft first diameter narrowing to a shaft second diameter defined by a rod shaft extension 27 that is slidably and complementarily received coaxially through a mounting nut 25 that is threadedly directed into an upper portion of the handle shaft head 13 to permit ease of removal and maintenance of the organization. In this manner, the mounting nut 25 may be removed along with the associated piston and shaft structure to fill the cavity 20 with a desired soap fluid. A spring 29 is captured between the piston 22 and the floor 21 to bias the piston in a raised orientation, whereupon projection of the piston downwardly into the cavity 20 directs the fluid soap solution as discussed above through fluid ports 30 radially directed through the handle shaft 12 communicating the handle shaft cavity 20 to a water environment exterior thereto for the amusement and entertainment of an individual, such as a child within a bathtub for example.

Figures 7, 8B:
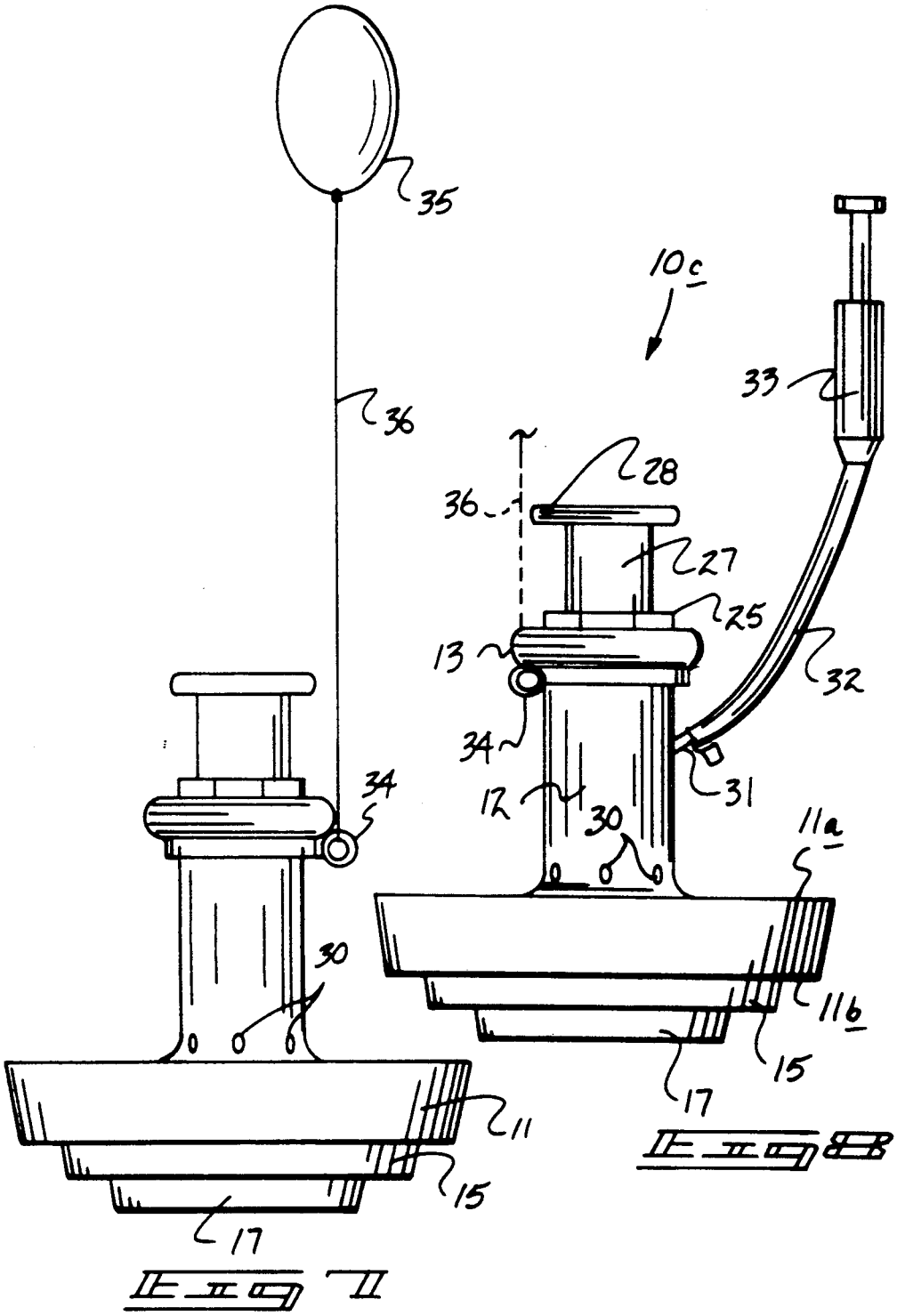
FIG. 7 is an orthographic side view of a modification of the invention.

A yet further modified aspect of the invention 10*c*, as illustrated in the FIGS. 7 and 8, illustrates the use of a fill port 31 directed through the shaft 12 into the cavity 20 to permit ease of filling of the cavity without requiring removal of the mounting nut 25 to thereby permit filling while the apparatus 10*c* remains within a drain plug and thereby permits the filling of the cavity 20 even when surrounded by water, such as in a bathtub situation. The fill port 31 includes a fill conduit 32 secured thereto, wherein a fill pump 33 mounted to an upper distal end of the fill conduit 32 permits expressing and projecting of replenishment soap solution within the cavity 20. A support ring 34 mounted to the handle shaft 12 has secured thereto a balloon tether line 36, wherein an upper distal end of the balloon tether line 36 mounts the balloon 35 filled with either air or helium permitting the location of the apparatus 10*c* even when limited visibility is available in surrounding water that may, due to soap solution or other water borne material, limit visibility through such water to the apparatus 10*c*.

As to the matter of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain stopper apparatus for insertion within a fluid drain comprising, an inverted truncated first conical base, the first conical base including a first base top surface defined by a first diameter spaced from and parallel a first base bottom surface defined by a second diameter less than the first diameter, and the first base top surface including a cylindrical handle shaft fixedly and coaxially mounted to the first base top surface extending upwardly thereof, wherein the shaft includes a shaft head, the shaft defined by a third diameter less than the first diameter and less than the second diameter, and wherein the shaft head is defined by a fourth diameter greater than the third diameter and less than the second diameter, and an inverted truncated conical second base fixedly and coaxially mounted to the first base bottom surface, wherein the second base includes a second base top surface contiguous with the first base bottom surface defined by a fifth diameter less than the second diameter defined by a second base bottom surface defined by a sixth diameter less than the fifth diameter, and further including a third base integrally and coaxially mounted to the second base bottom surface defined by a third base top surface defined by a seventh diameter less than the sixth diameter, and wherein a third base bottom surface defined by an eighth diameter less than the seventh diameter, and the first base top surface, the first base bottom surface, the second base top surface, the second bottom surface, the third base top surface, and the third base bottom surface are arranged in a coaxial parallel relationship relative to one another, and the handle shaft includes a handle shaft cavity coaxially and coextensively directed through the handle shaft and the handle shaft head, and a rigid cylindrical sleeve mounted within the handle shaft cavity and wherein the handle shaft head threadedly receives a mounting nut, wherein the mounting nut is mounted coaxially of the handle shaft and the handle shaft head and in abutment with an upper distal end of the sleeve to position and align the sleeve within the handle shaft, and a plurality of ports directed through the handle shaft adjacent the first base top surface, wherein the ports are radially directed through the handle shaft and the sleeve for communication with the handle shaft cavity, and the handle shaft cavity including a cavity floor generally coplanar with the first base top surface, and further including a piston slidably and sealingly mounted within the sleeve spaced from the floor and including a spring captured between the floor and the piston to project the piston in a biased relationship spaced from the floor, and the piston including a piston rod coaxially directed through the sleeve and the mounting nut projecting exteriorly thereof permitting manual projection of the piston within the cavity to project fluid contained within the cavity through the ports.

2. An apparatus as set forth in claim 1 wherein a fill port is mounted through the handle shaft and the sleeve in communication with the cavity and extending radially beyond the handle shaft, wherein the fill port includes a fill conduit mounted to the fill port, and the fill conduit includes a conduit upper distal end with a fill pump mounted to the upper distal end, wherein the fill pump permits selective refilling of the handle shaft cavity by directing fluid from the fill pump through the fill conduit, through the fill port, and into the handle shaft cavity.

3. An apparatus as set forth in claim 2 including a support ring mounted to the handle shaft spaced from the fill port, wherein the support ring includes a tether line, the tether line including a tether line lower distal end, the tether line lower distal end mounted to the support ring, and the tether line including a tether line upper distal end, the tether line upper distal end including a pneumatically filled balloon to provide for visual positioning of the handle shaft within a body of water.

* * * * *